United States Patent [19]

Murayama

[11] Patent Number: 4,809,518

[45] Date of Patent: Mar. 7, 1989

[54] LAMINATE TYPE EVAPORATOR WITH EXPANSION VALVE

[75] Inventor: Kouji Murayama, Tatebayashi, Japan

[73] Assignee: Nihon Radiator Co., Ltd., Tokyo, Japan

[21] Appl. No.: 100,091

[22] Filed: Sep. 23, 1987

[30] Foreign Application Priority Data

Sep. 24, 1986 [JP] Japan ..... 61-223845

[51] Int. Cl.[4] ..... F25B 41/04

[52] U.S. Cl. ..... 62/225; 62/527

[58] Field of Search ..... 62/225, 224, 222, 214, 62/208, 209, 210, 204, 223, 527, 528

[56] References Cited

U.S. PATENT DOCUMENTS

| | | | |
|---|---|---|---|
| 1,719,073 | 7/1927 | Muffly | 62/225 |
| 1,960,433 | 5/1934 | Beman | 62/224 X |
| 2,520,191 | 8/1950 | Aughey et al. | 62/225 |
| 4,542,852 | 9/1985 | Orth et al. | 62/225 X |
| 4,589,265 | 5/1986 | Nozawa | 62/527 X |
| 4,712,384 | 12/1987 | Crowe | 62/225 |

FOREIGN PATENT DOCUMENTS

| | | | |
|---|---|---|---|
| 47586 | 10/1982 | Japan . | |
| 225702 | 12/1984 | Japan . | |
| 2073391 | 10/1981 | United Kingdom | 62/527 |

*Primary Examiner*—Harry B. Tanner

*Attorney, Agent, or Firm*—Gordon W. Hueschen

[57] ABSTRACT

A cylindrical expansion valve is mounted in a tank portion of a laminate type evaporator formed by alternately laminating flat sheet tubes and heat transfer fins. With this arrangement, the structure of the evaporator is made compact as a whole, and a conventional piping work for connecting the evaporator body with a thermo-sensing cylinder is eliminated, thereby rendering the assembling operation easy.

7 Claims, 3 Drawing Sheets

LAMINATE TYPE EVAPORATOR WITH EXPANSION VALVE

BACKGROUND OF THE INVENTION

1. Field of the Invention

The present invention relates to a laminate type evaporator with an expansion valve for use with a cooling cycle of an air conditioning device for an automobile.

2. Description of the Prior Art

The laminate type evaporator for use with the cooling cycle of the air conditioning device for the automobile has been recently increased since it is superior in a heat exchanging performance to the other type evaporators (fin and tube type and serpentine type, etc.).

Generally, an evaporator body of the laminate type evaporator is provided with an expansion valve, (Japanese Utility Model Publication SHO 57(1982)-47586). The evaporator body is formed by combining a pair of flat plates having an expanded portion with each other to form a flat sheet tube, and alternately laminating a plurality of the sheet tubes and heat transfer fins.

Each sheet tube is formed at its upper and lower end portions with tank portions communicated with each other. A refrigerant is temporarily stored and mixed in the tank portions.. A refrigerant passage for feeding the refrigerant is formed at the intermediate portion between the upper and lower tank portions.

An inlet pipe for inducing the refrigerant into the evaporator body is connected to the lower tank portion, and an outlet pipe for discharging the refrigerant from the evaporator body is connected to the upper tank portion. The inlet pipe is provided with an expansion vale for restricting and expanding the refrigerant,, and a conduit for connecting the evaporator body with a compressor is connected to the outlet pipe.

The expansion valve serves to control a flow rate of the refrigerant flowing in the evaporator body according to a heat load to be applied to the evaporator body. After heat exchanging in the evaporator body, the expansion valve detects the temperature and pressure of the refrigerant to be discharged from the outlet pipe and control opening degree of the valve.

Namely, the outlet pipe is provided with a thermo-sensing cylinder for sensing the temperature of the refrigerant and a pressure inducing portion for extracting the pressure of the refrigerant flowing therethrough. Both the thermo-sensing cylinder and the pressure inducing portion are communicated with the expansion valve by capillary tubes, thus effecting the sensing of temperature and the induction of pressure.

In assembling the evaporator with the expansion valve, it is necessary to connect the expansion valve with the inlet pipe, connect the thermo-sensing cylinder with the outlet pipe, form the pressure inducing portion in the outlet pipe, and connect the pressure inducing portion through the capillary tube to the expansion valve, for example. Thus, much labor is disadvantageously needed so as to complete the evaporator. Furthermore, as the expansion valve is mounted to a usual evaporator is located at a portion where the air flows, the expansion valve itself hinders the air flow, and there is a possibility of the heat exchanging performance being reduced.

Japanese Patent Laid-Open SHO 59(1984)-225702 discloses an evaporator wherein the expansion valve as mentioned above is directly mounted to the sheet tube on the side end of the evaporator. In this construction, the box-like expansion valve projects from the substantially rectangular evaporator body, causing a large size of the evaporator as a whole and rendering the installation of the evaporator disadvantageous in the viewpoint of space. Particularly in the air conditioning device for the automobile requiring to install the evaporator in a small space, such a large size of the evaporator is undesirable.

SUMMARY OF THE INVENTION

The present invention is intended to eliminate the above disadvantages in respect of the installation and the space, and it is a first object of the present invention to provide a laminate type evaporator with an expansion valve wherein the expansion valve may be made compact by mounting a control portion and a valve portion in a cylindrical casing, and the capillary tube and the like connecting the expansion valve with the evaporator body and the associated connecting work may be eliminated by installing the expansion valve in the evaporator body.

It is a second object of the present invention to provide a laminate type evaporator with an expansion valve which may be made compact as a whole and improve the heat exchanging performance by installing a cylindrical expansion valve in a tank portion of the evaporator where the heat exchanging operation is not exhibited.

It is a third object of the present invention to provide a laminate type evaporator with an expansion valve wherein the expansion valve itself may be easily mounted.

According to the present invention, there is provided in a laminate type evaporator including a flat sheet tube formed by combining a pair of flat plates, said sheet tube having a tank portion and a refrigerant passage therein, a heat transfer fin, an evaporator body formed by alternately laminating a plurality of the heat transfer fins, an inlet pipe for inducing a refrigerant to the tank portion, an outlet pipe for discharging the refrigerant, and an expansion valve connected to the inlet pipe, wherein an opening degree of the expansion valve is controlled according to a condition of the refrigerant flowing in the outlet pipe; the improvement wherein the expansion valve comprises a valve portion for controlling a flow rate of the regrigerant and a control portion for controlling the opening degree of the valve portion, said the valve portion and the control portion are provided in a cylindrical casing, and the expansion valve is mounted in the tank portion.

With this construction as mentioned above, the installation of the expansion valve to the evaporator body is completed only by mounting the compact cylindrical expansion valve into the tank portion of the evaporator body. Accordingly, the piping work of the capillary tubes and the like and the forming work of the pressure inducing portion as needed by the prior art may be eliminated, and additionally the installation of the expansion valve itself may be made easy.

Furthermore, as the expansion valve is mounted in the tank portion of the evaporator body, the external shape of the evaporator may be made compact. Accordingly, the evaporator may be easily mounted even in a greatly small space. In addition, as an air communication space in the evaporator is not occupied by the expansion valve, the heat exchanging performance is not reduced.

DETAILED DESCRIPTION OF THE PREFERRED EMBODIMENTS

There will now be described a preferred embodiment of the laminate type evaporator with an expansion valve according to the present invention.

Figure 1:
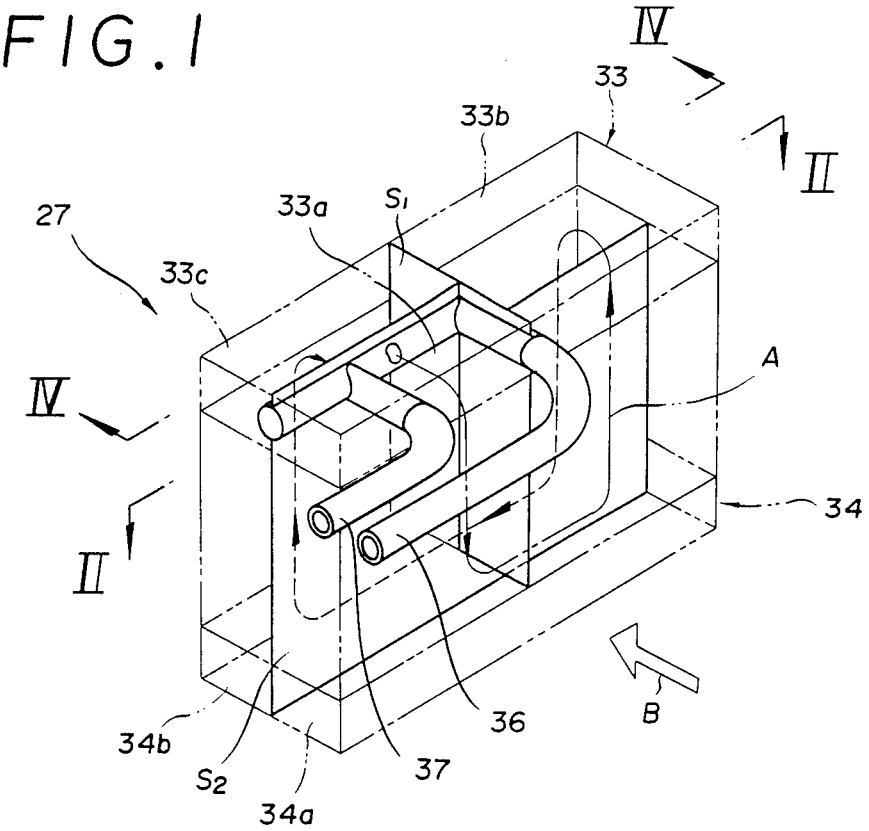
FIG. 1 is a schematic perspective diagram of the laminate type evaporator with an expansion valve showing a preferred embodiment of the present invention.
Figure 3:
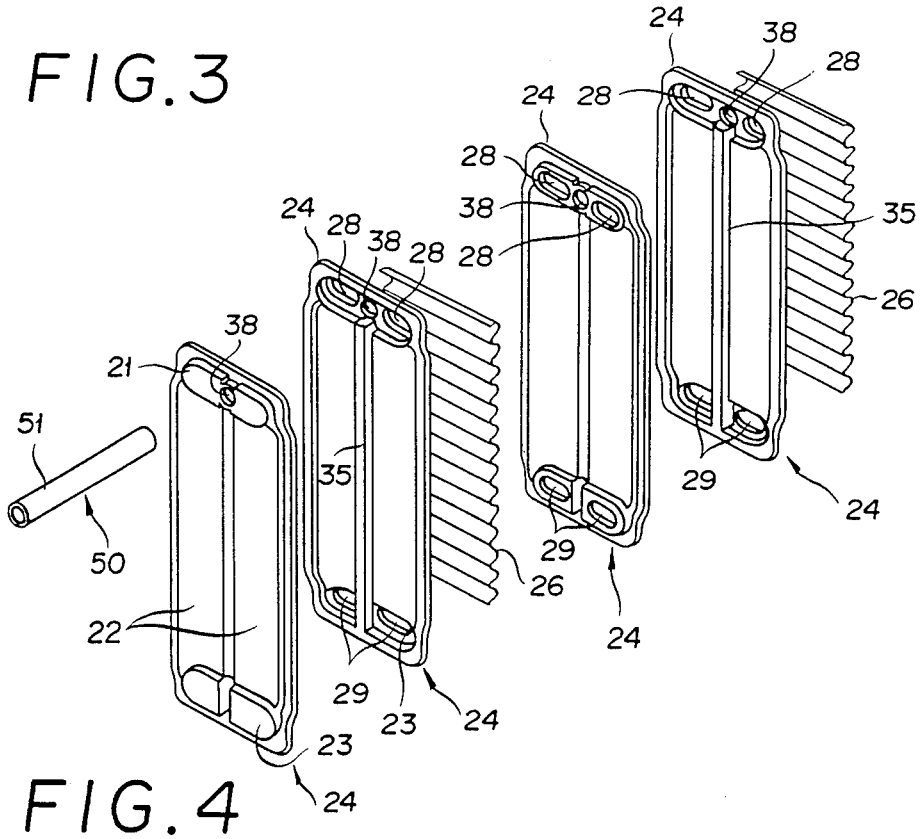
FIG. 3 is an exploded perspective view of the evaporator showing a manufacturing process.

Referring to FIG. 1, reference numeral 20 generally designates a laminate type evaporator with an expansion valve. An evaporator body 27 of the evaporator 20 is constructed by combining flat plates 24 each having expanded portions 21, 22 and 23 as shown in FIG. 3 to form a sheet tube 25 and alternately laminating plural sheet tubes 25 to heat transfer fine 26.

Figure 4:
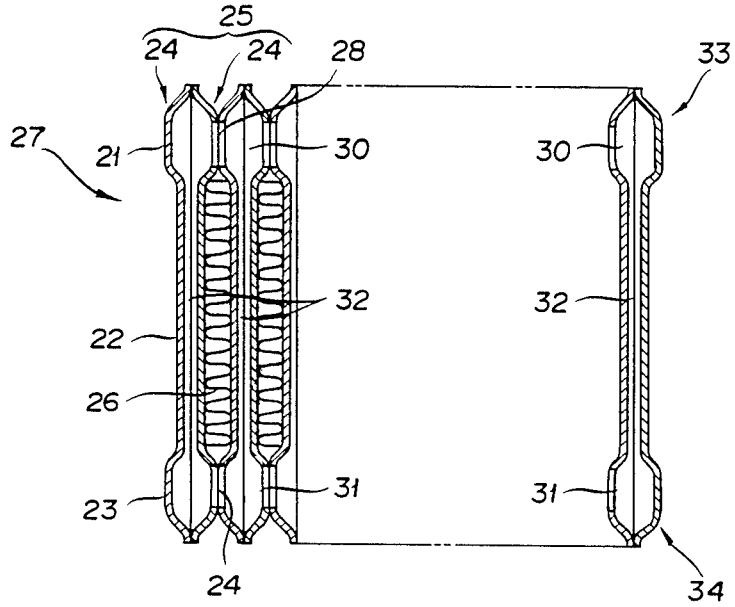
FIG. 4 is a cross section taken along the line IV—IV in FIG. 1.

As shown in FIG. 4, some of the expanded portions 21 and 23 formed at the upper and lower ends of the flat plate 24 are provided with communication holes 28 and 29. The flat plates 24 having the communication holes 28 and 29 are combined to form the sheet tube 25, and a plurality of the sheet tubes 25 are laminated one another with the heat transfer fine 26 interposed therebetween. Accordingly, a plurality of tank portions 30 and 31 are formed at the upper and lower ends of the evaporator body 27, and the upper and lower tank portions 30 and 31 are communicated to each other through refrigerant passages 32.

The flat plates 24 having no communication holes 28 and 29 may be located at a suitable position in the evaporator body 27 to combine the upper and lower tank portions 30 and 31 and form an upper and lower tank sections 33 and 34. As shown in FIG. 1, the upper and lower tank sections 33 or 34 is partitioned by a partition board $S_1$ at a suitable position.

Furthermore, each flat plate 24 may be formed at its central portion with an expanded portion 22, and a bead portion 35 is formed at a central position of the expanded portion 22 in a direction of air flow. Such flat plates 24 are combined to form the sheet tube 25. Accordingly, the refrigerant passage 32 is divided into two sections by a partition board $S_2$.

As described above, the flat plates 24 to be laminated are formed or are not formed with the communication holes 28 and 29 at the tank portions and with the bead portion 35. Alternatively, the location of the communication holes 28 and 29 and the bead portion 35 is varied. With this arrangement, the partition boards $S_1$ and $S_2$ are formed to partition the upper tank section 33 into first, second and third upper tank sections 33*a*, 33*b* and 33*c* and partition the lower tank section 34 into first and second tank sections 34*a* and 34*b*.

Referring to FIG. 1, an arrow A shows a flow of refrigerant in the laminate type evaporator 20. The refrigerant is admitted from an inlet pipe 36 located at the upstream side of an air flow B into the first upper tank portion 33*a*. Then, it passes through the refrigerant passage 32 to the left front half area of the first lower tank portion 34*a*. Then, it is fed to the right front half area of the first lower tank portion 34*a*. Then, it passes through the refrigerant passage 32 to the front half area of the second upper tank portion 33*b*. Then, the refrigerant takes a U-turn to downwardly flow through the rear half area of the second upper tank portion 33*b* and the refrigerant passage 32 to the right rear half area of the second lower tank portion 34*b*. Then, it is fed to the left rear half area of the second lower tank portion 34*b* and upwardly flow through the refrigerant passage 32 to the second upper tank portion 33*c*. Finally, the refrigerant is discharged from the second upper tank portion 33*c* through an outlet pipe 37.

Referring to FIG. 3, pipe insertion holes 38 are formed along the partition board $S_2$ at the center of the upper expanded portion 21 of a predetermined number of flat plates 24. With this arrangement, a tank capacity of the first upper tank section 33*a* or the second upper tank section 33*c* may be prevented from being greatly reduced. A cylindrical casing 51 of an expansion valve 50 is mounted in the pipe insertion holes 38.

Figure 2:
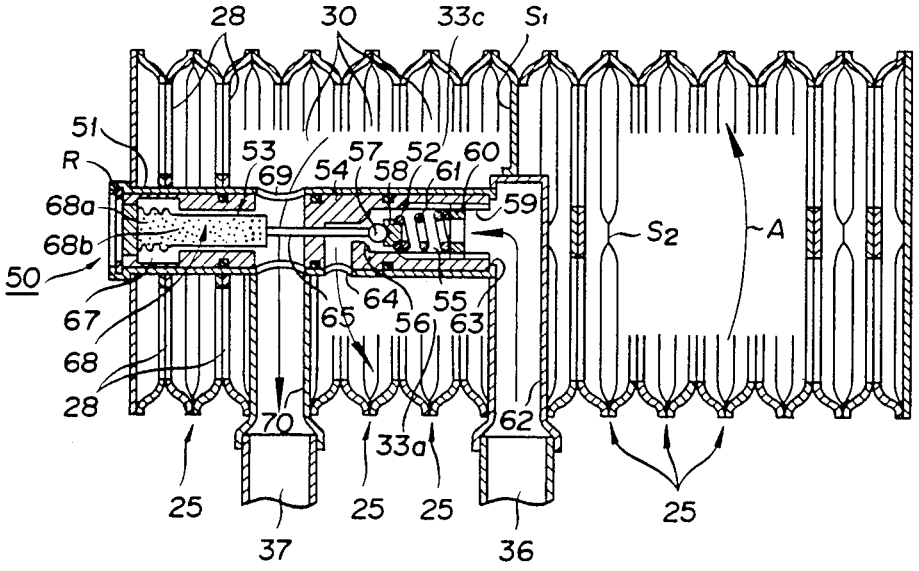
FIG. 2 is a cross section taken along the line II—II in FIG. 1.

Referring to FIG. 2, there are provided in the cylindrical casing 51 a valve portion 52 and a control portion 53 for controlling the valve portion 52. The valve portion 52 and the control portion 53 are detachably mounted in the cylindrical casing 51 by a snap ring R.

The valve portion 52 of the expansion valve 50 includes a cylinder block 54 engaged in the cylindrical casing 51 through an O-ring and the like for preventing the leakage of the regrigerant. A refrigerant channel 55 is defined in the cylinder block 54. A throat portion 56 is formed on the way of the refrigerant channel 55, and a valve member 57 is provided to open and close the throat portion 56 and adjust an opening degree of the throat portion 56. A receiving plate 58 is provided to about against the valve member 57, and a supporting plate 60 is threadedly engaged with a thread portion 59 of the cylinder block 54 in such a manner that an axial position of the supporting plate 60 may be adjusted. A coil spring 61 is interposed between the receiving plate 58 and the supporting plate 60. The insert end of the cylindrical casing 51 is opened and communicated with an opening 63 of an adapter 62 connected to the inlet pipe 36. Accordingly, the refrigerant admitted from the inlet pipe 36 is allowed to flow through the adapter 62, the cylinder block 54, the throat portion 56 and an aperture 64 formed through the cylindrical casing 51 into the first upper tank section 33*a*.

The valve member 57 is connected through a rod 65 to the control portion 53. The control portion 53 is provided at the rear end portion of the cylinder block 54 sealed by an O-ring and the like at the end portion of the cylindrical casing 51. The control portion 53 is formed by a thermo-sensing cylinder 68 received in a space 67 defined in the cylinder block 54.

The thermo-sensing cylinder 68 comprises a bellows portion 68*a* and a cylindrical portion 68*b* integrally formed with the bellows portion 68*a*. The thermo-sensing cylinder 68 is filled with a thermo-sensing gas or wax, and is operable by the temperature of the refrigerant gas admitted from an aperture 69 formed through the cylindrical casing 51 into the space 67. When the temperature of the regrigerant gas surrounding the thermo-sensing cylinder 68 is high, the gas and the like in the thermo-sensing cylinder 68 is expanded to extend the bellows portion 8*a*. As a result, the valve member 57 is axially moved through the rod 65 to open the throat portion 56. In contrast, when the temperature of the refrigerant gas surrounding the thermo-sensing cylinder 68 is low, the operation of the cylinder 68 is reversed to the above In this manner, the clearance between the throat portion 56 and the valve member 57 is adjusted to thereby effect flow control and adiabatic expansion of the refrigerant.

At the same time, the pressure of the regrigerant is also applied to the bellows portion 68*a* and the cylindrical portion 68*b*. Consequently, the movement of the valve member 57 is controlled by the temperature and the pressure of the refrigerant.

The outlet pipe 37 is communicated through an adapter 70 to the aperture 69, and discharges the regrigerant led from the final tank section 33*c*.

In manufacturing the laminate type evaporator 20 with the expansion valve as mentioned above, the flat plates 24 shown in FIG. 3 are combined one another to form the sheet tube 25, and a plurality of the sheet tubes 25 are laminated as shown in FIG. 4. In this stage, the cylindrical casing 51, the adapters 62 and 70 and the inlet and outlet pipes 36 and 37 are inserted into the sheet tube 25, and are brazed together in an oven. Then, the cylinder block 54 forming the expansion valve 50 is inserted into the cylindrical casing 51, and a thermo-sensing gas and the like is sealed in the thermo-sensing cylinder 68. Then, the cylinder block 54 is fixed by the snap ring R. Thus, the installation of the expansion valve 50 to the evaporator 20 is completed by the simple operation. That is to say, the thermo-sensing cylinder 68 and the valve portion 52 are communicated with each other without using a capillary tube and the ,like. Furthermore, the sensing of temperature and the induction of pressure are attainable without forming a pressure inducing portion.

In this embodiment, as the expansion valve 50 is installed in the upper tank section 33 where the heat exchanging operation of the evaporator 20 is not exhibited, the external shape of the evaporator 20 is made compact as a whole, and there is no possibility that the air flow is hindered by the expansion valve, thereby preventing the reduction in the heat exchanging effect of the evaporator.

Figure 5:
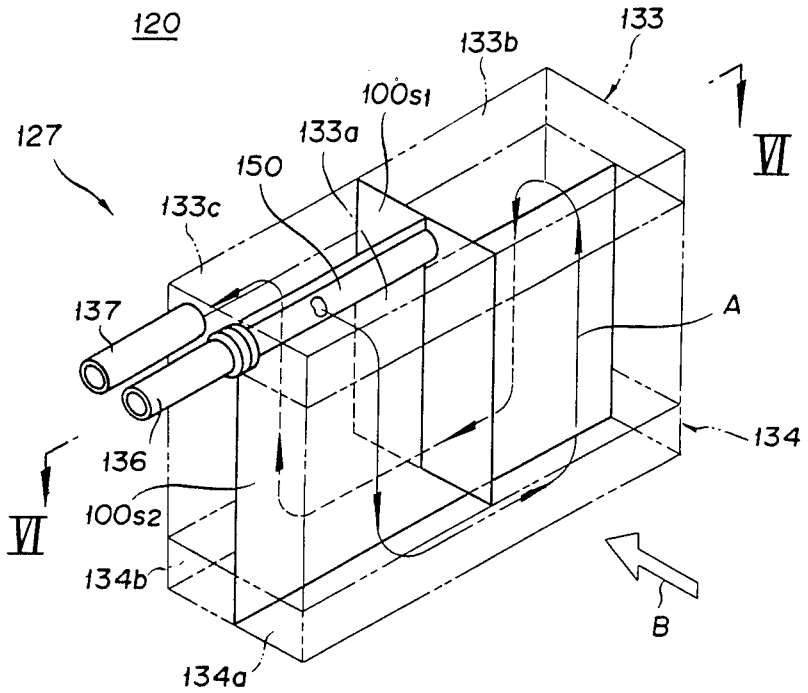
FIG. 5 is a schematic perspective diagram of the laminate type evaporator with an expansion valve showing another preferred embodiment of the present invention.
Figure 6:
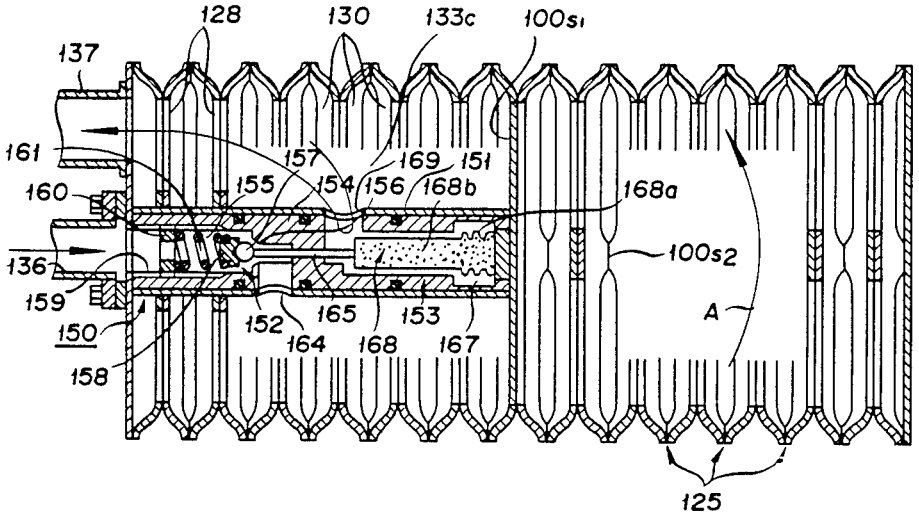
FIG. 6 is a cross section taken along the line VI—VI in FIG. 5.

The present invention is not limited to the construction of the previous embodiment. Referring to FIGS. 5 and 6 which show another embodiment of the present invention (The same elements as in FIGS. 1 to 4 are designated by the, same references plus 100), the connecting positions of an inlet pipe 136 and an outlet pipe 137 to an evaporator 120 are located on the side surface of the evaporator 120. In this embodiment, an expansion valve 150 is installed in a direction reversed to that in the previous embodiment.

As described above, since the expansion valve is installed in the evaporator, the assembling of the expansion valve with the evaporator may be made easy and the manpower may be greatly reduced. Moreover, since the external shape of the evaporator is made compact as a whole, the evaporator may be installed in a greatly small space in spite of mounting the expansion valve therein. Further, the heat exchanging performance of the evaporator itself is not reduced.

What is claimed is:

1. In a laminate type evaporator including a flat sheet tube formed by combining a pair of flat plates, said sheet tube having a tank portion and a refrigerant passage therein, a heat transfer fin, an evaporator body formed by alternately laminating a plurality of said sheet tubes and a plurality of said heat transfer fins, an inlet pipe for inducing a refrigerant to said tank portion, an outlet pipe for discharging said refrigerant, and an expansion valve connected to said inlet pipe, wherein an opening degree of said expansion valve is controlled according to a condition of said refrigerant flowing in said outlet pipe; the improvement wherein said expansion valve comprises a valve portion for controlling a flow rate of said refrigerant and a control portion for controlling the opening degree of said valve portion, said the valve portion and said control portion are provided in a cylindrical casing, and said expansion valve is mounted in said tank portion.

2. The laminate type evaporator as defined in claim 1, wherein, said expansion valve comprises a cylindrical casing communicating at one end with said inlet pipe, a valve portion comprising a cylinder block engaged in said cylindrical casing and provided with a narrow throat portion and a valve member adapted to be axially moved to control an opening degree of said throat portion, and a thermo-sensing portion connected through a rod to said valve member for adjusting the axial movement of said valve member according to a sensed physical condition of said refrigerant.

3. The laminate type evaporator as defined in claim 2, wherein said valve portion is arranged between said inlet pipe and a first tank portion for first receiving said refrigerant admitted from said inlet pipe, and said thermo-sensing portion is arranged between said outlet pipe and a final tank portion for receiving said refrigerant after circulated in said evaporator body.

4. The laminate type evaporator as defined in claim 3, wherein said evaporator body is partitioned by a partition board in such a manner that an inlet portion and an outlet portion for said refrigerant are located on one side, and said cylindrical casing is inserted on said partition board.

5. The laminate, type evaporator as defined in claim 4, wherein said evaporator body is partitioned by a partition board formed at a central position of said sheet tubes in a direction of air flow.

6. The laminate type evaporator as defined in claim 5, wherein said inlet pipe and said outlet pipe are connected to said evaporator body in a direction perpendicular to the direction of air flow.

7. The laminate type evaporator as defined in claim 6, wherein an end portion of said cylindrical casing is communicated with said inlet pipe, and an aperture communicating with said final tank portion is formed through said cylindrical casing at the position where said thermo-sensing portion is located.

* * * * *

UNITED STATES PATENT AND TRADEMARK OFFICE

CERTIFICATE OF CORRECTION

PATENT NO. : 4,809,518

DATED : March 7, 1989

INVENTOR(S) : Kouji Murayama

It is certified that error appears in the above-identified patent and that said Letters Patent is hereby corrected as shown below:

Title Page, [56] References Cited, U.S. PATENT DOCUMENTS, line 1; "7/1927" should read -- 7/1929 --

Col. 1, line 34; "vale" should read -- valve --
Col. 1, line 60; "is" should read -- as --
Col. 2, line 47; "regrigerant" should read -- refrigerant --
Col. 4, line 36; "regrigerant" should read -- refrigerant --
Col. 4, line 42; "about" should read -- abut --
Col. 5, lines 1, 13 and 19; "regrigerant" should read -- refrigerant -- (all three instances)
Col. 5, line 9; after "above" insert a period -- . --
Col. 5, line 37; before "like." delete the comma ","
Col. 6, line 20; delete "the"
Col. 6, line 25; delete the comma "," after "wherein"
Col. 6, line 49; delete the comma "," after "laminate"

Signed and Sealed this

Tenth Day of October, 1989

*Attest:*

DONALD J. QUIGG

*Attesting Officer*

*Commissioner of Patents and Trademarks*